United States Patent [19]

Asbury

[11] 4,252,247

[45] Feb. 24, 1981

[54] TEAR-OPEN CAN LID WITH PUSH-IN TABS

[76] Inventor: Charles T. Asbury, 717 Isle of Palms, Fort Lauderdale, Fla. 33301

[21] Appl. No.: 94,845

[22] Filed: Nov. 16, 1979

[51] Int. Cl.[3] ..... B65D 41/32

[52] U.S. Cl. ..... 220/268; 220/271

[58] Field of Search ..... 220/265–273; 215/250, 253

[56] References Cited

U.S. PATENT DOCUMENTS

| | | | |
|---|---|---|---|
| 3,227,304 | 1/1966 | Asbury | 220/268 |
| 3,334,797 | 8/1967 | Latham et al. | 220/268 X |
| 3,779,417 | 12/1973 | Klein | 220/268 |
| 3,982,657 | 9/1976 | Keller et al. | 220/268 |
| 4,003,494 | 1/1977 | Smith et al. | 220/268 |
| 4,134,517 | 1/1979 | Rhoades | 220/268 |

*Primary Examiner*—George T. Hall

*Attorney, Agent, or Firm*—Oltman and Flynn

[57] ABSTRACT

The present can lid has an upwardly-pojecting domed segment, a narrower marginal lip extending radially outward from the domed segment and terminating in intersecting arcuate score lines which are indented in the top of the lid, an upwardly-offset hollow rib extending across the domed segment and across the marginal lip at the ends of the score lines away from their intersection, and a short upwardly-offset hollow rib on the marginal lip at the intersection of the score lines. The short rib has a radially extending score line in the top which facilitates breaking the can lid first at the intersection of the arcuate score lines when the domed segment is pushed in, after which the can lid tears open progressively along these score lines out to the transverse rib.

9 Claims, 9 Drawing Figures

TEAR-OPEN CAN LID WITH PUSH-IN TABS

SUMMARY OF THE INVENTION

This invention relates to a can lid having a push-in tear-open tab.

Various tear-open lids have been proposed heretofore for beer and carbonated soft drink cans. For example, my U.S. Pat. Nos. 3,227,304, 3,246,791, 3,355,058 and 4,078,693 show tear-open push-in tabs which remain attached to the remainder of the can lid after being pushed in to provide the pour opening. Other push-in tabs which remain attached to the can lid are shown in U.S. Pat. No. 2,176,898 to Fried, U.S. Pat. Nos. 2,261,117 to Jack and 3,779,417 to Klein.

The present invention is directed to a can lid having a novel push-in tear-open tab that can be pushed open with a moderate amount of force, and does not subject the user's finger or thumb to the likelihood of being cut when pushing in the tab, and remains permanently attached to the remainder of the can lid after being pushed in.

In accordance with the presently preferred embodiments of this invention, the can lid has:

(1) an upwardly-projecting domed segment of circular outline;

(2) a substantially flat marginal lip extending radially outward from the domed segment and terminating in intersecting score lines which are indented into the top of the lid and extend generally parallel to the adjacent circular edge of the domed segment;

(3) an upwardly-offset hollow rib extending transversely across the domed segment and across the marginal lip at the ends of the score lines away from where they intersect;

(4) and a short upwardly-offset hollow rib extending radially inward across the marginal lip from the intersection of the score lines and having a radially extending score line indented into its top face.

When the user pushes down on the domed segment, the tab is severed from the remainder of the can lid first at the score line intersection and then it tears open progressively along the intersecting score lines out to the transverse rib. This rib defines the limits of the opening formed in the can lid by pushing in the tab.

Further objects and advantages of this invention will be apparent from the following detailed description of two presently preferred embodiments, shown in the accompanying drawings.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Figure 2:
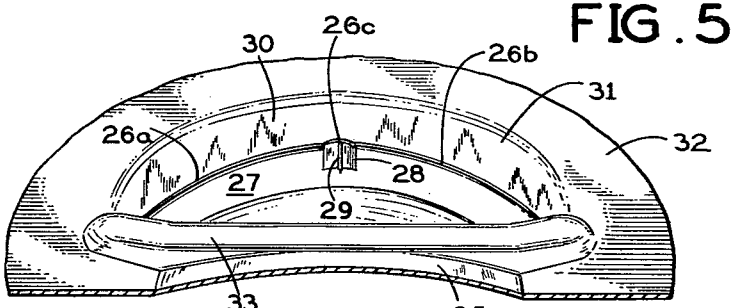
FIG. 2 is a fragmentary perspective view taken from the section line 2—2 in FIG. 1.
Figure 1:
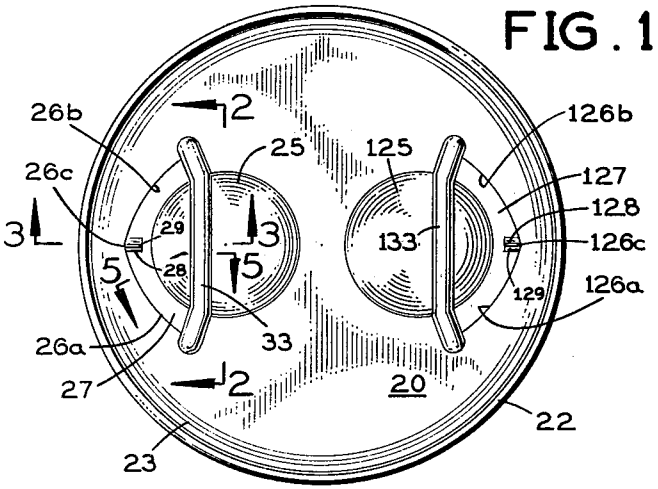
FIG. 1 is a top plan view of a can lid in accordance with a first embodiment of the present invention.

Referring first to FIGS. 1 and 2, the first embodiment of the present can lid has a central portion 20 which extends across the top of the cylindrical can body 21 (FIG. 2) and a hollow annular peripheral rib 22 which is sealingly attached to the top of the can body 21. As best seen in FIG. 2, the peripheral rib on the can lid comprises a rounded hollow bead **22*a* at the top, a depending annular outer skirt 22*b* extending down from the bead 22*a* along the outside of the can body at the latter's upper end; and a depending annular inner skirt 22*c* extending down from the bead 22*a*** along the inside of the can body at the latter's upper end.

At the lower end of the inner skirt **22*c* on the peripheral rib 22 the can lid is reversely curved to form a round-bottomed, upwardly-facing channel 23 located just inside the can body 21 a fraction of an inch below its top edge. This channel 23 extends circularly completely around the inside of the can body. At its radially inward side the channel 23 merges smoothly with a rounded annular corner segment 24, which curves upward and inward through a curvature of about 90 degrees and blends smoothly with the remainder of the can lid's central portion 20. Radially inward from the rounded corner 24** the central portion of the can body may be either flat or crowned for most of its extent. In the embodiment illustrated, it is generally flat.

On one side of its center the can lid is formed with an upwardly projecting domed segment 25, which is circular in outline. The top face of this domed segment is convex and its bottom face is concave. In one practical embodiment, the diameter of this domed segment is slightly less than one-third of the diameter of the central portion 20 of the can lid inside its peripheral rib 22.

A pair of oppositely curved score lines **26*a* and 26*b* are indented into the top face of the can lid between the domed segment 25 and the adjacent part of the peripheral rib 22 of the can lid. These score lines intersect each other (FIG. 1) at 26*c*, which is the initial break point for the tab when the domed segment 25 is pushed in. After breaking open first at 26*c*, the can lid will continue to tear open along the score lines 26*a* and 26*b* progressively away from the initial break point 26*c***.

Figure 4:
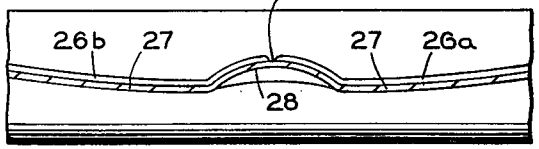
FIG. 4 is an enlarged fragmentary vertical section taken along the line 4—4 in FIG. 3.

Between the bottom edge of the domed segment 25 and the score lines **26*a* and 26*b* the can lid presents a generally flat, arcuate, marginal lip 27. The marginal lip is substantially narrower than the domed segment 25 radially of the can lid. A short, rounded, hollow rib 28 projects up from the marginal lip 27 beginning at the initial break point 26*c* (FIG. 1) and extending a very short distance radially inward therefrom, terminating short of the adjacent bottom edge of the domed segment 25. As best seen in FIG. 4, this rib is formed with a score line 29 indented in the center of its top face and extending radially of the can lid along substantially the entire radial extent of the upwardly projecting rib 28. This score line helps insure that when the domed segment 25 is pushed in, the can lid will break open first at the initial break point 26c**, which is at the outer end of this score line.

Figure 5:
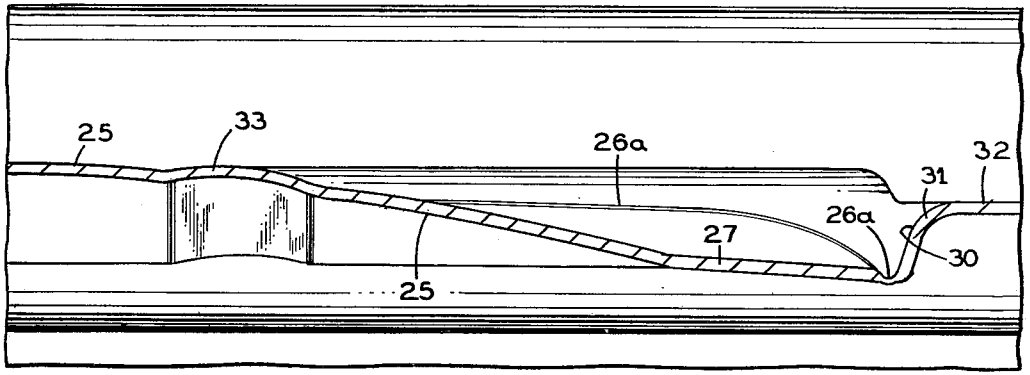
FIG. 5 is an enlarged fragmentary cross-section taken along the line 5—5 in FIG. 1.
Figure 3:
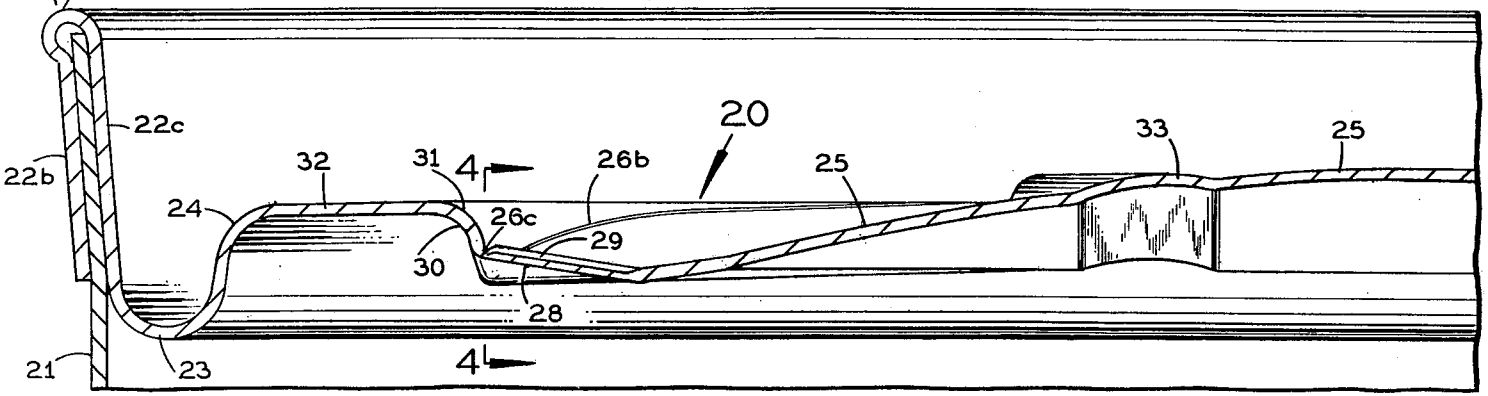
FIG. 3 is an enlarged fragmentary cross-section taken along the line 3—3 in FIG. 1.

As best seen in FIGS. 2 and 5, the can lid presents an upwardly and outwardly inclined wall 30 immediately outside the intersecting score lines 26a and 26b along their entire length. At its upper end this wall 30 blends smoothly with a rounded corner 31 (FIG. 5), which extends into a generally horizontal segment 32 of the can lid, which extends outward to the previously-mentioned rounded corner 24 (FIG. 3).

In one practical embodiment, the can lid is of 0.009 inch thick sheet material, except at the hollow rib 28 the score lines 26a and 26b are 0.005 inch deep (leaving a residual can lid thickness of 0.004 inch at these score lines), across the hollow rib 28 (i.e., in the immediate vicinity of the break point 26c) the score lines are about 0.0058 inch deep (leaving a residual can lid thickness of 0.0032 inch), and the indentation 29 is 0.004 inch deep (leaving a residual thickness of 0.005 inch in the raised rib 28 along this score line).

An upwardly offset, hollow rib 33 is formed in the domed segment 25, extending transversely across it at a location offset from the center of the domed segment toward the raised rib 28. This rib 33 also extends completely across the marginal lip 27 on opposite sides of the domed segment 25, and it extends into the flat segment 32 of the can lid. The intersecting score lines 26a and 26b end at this rib 33. The rib 33 acts as a rigid structural element of the can lid which limits the extent to which the tab can be bent and torn away from the rest of the can lid when pushed in.

The user opens the can lid by pushing down on the domed segment 25 with his finger or thumb. The can lid tears open first at point 26c, where the score lines 26a and 26b intersect each other and the score line 29 in the raised rib 28. Continued downward pressure on the domed segment causes the can lid to continue to tear open along each score line 26a and 26b out to the rib 33, where the tearing ends.

From the foregoing description and the drawings it will be evident that the push-in tab on the can lid consists of the portion of the can lid between the raised transverse rib 33 and the intersecting score lines 26a and 26b. This tab, after being pushed in, remains attached to the remainder of the can lid along the transverse rib 33.

A second push-in tab of identical construction preferably is formed in the can lid at the opposite side of its center. Corresponding elements of this second tab are given the same reference numerals plus 100 as the just-described elements of the first pour tab.

After both tabs have been opened, the opening at one tab serves as the pour opening for the liquid contents of the can while the opening at the other tab serves as the vent opening for admitting air into the can as it is being poured.

Figure 8:
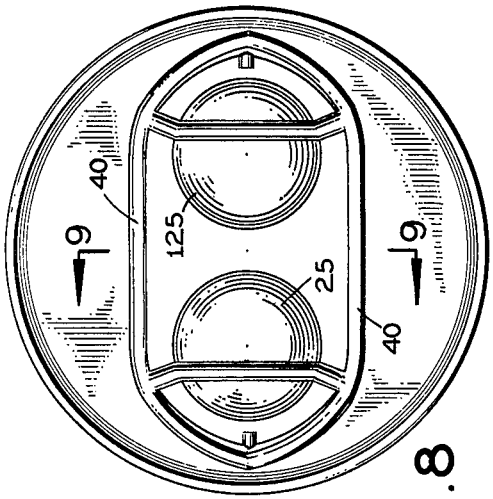
FIG. 8 is a top plan view of a can lid in accordance with a second embodiment of the present invention.
Figure 9:
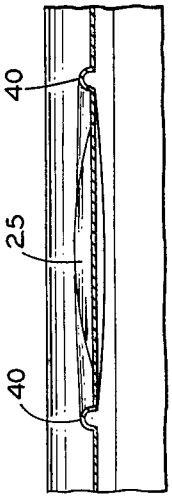
FIG. 9 is a fragmentary cross-section taken along the line 9—9 in FIG. 8.
Figure 6:
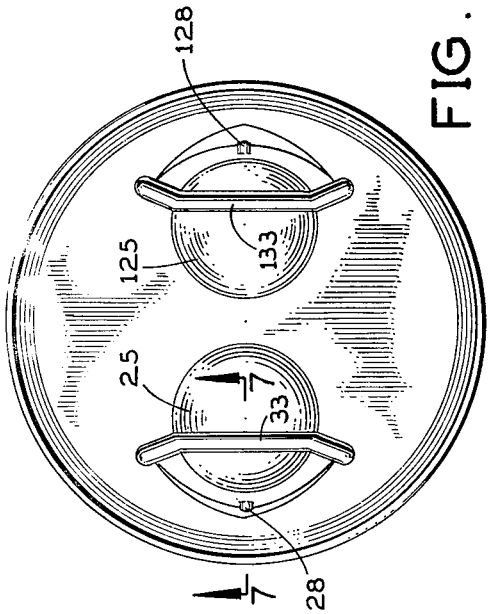
FIG. 6 is a top plan view of this can lid with the tabs snapped open.
Figure 7:
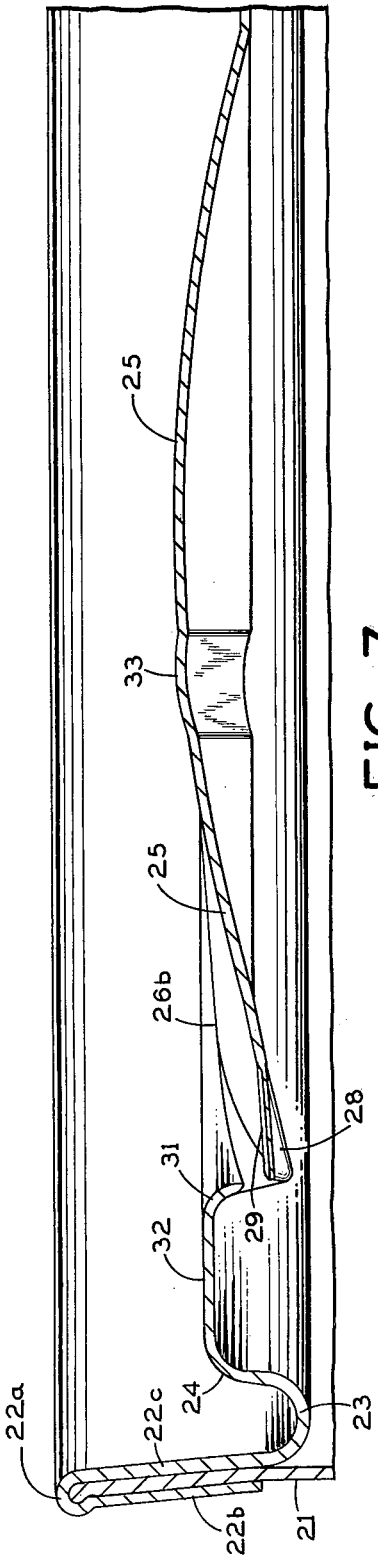
FIG. 7 is an enlarged cross-section taken along the line 7—7 in FIG. 6 and showing one tab pushed open.

FIGS. 8 and 9 show a second embodiment of the invention which is the same as the embodiment of FIGS. 1–7 except for the addition of a continuous raised, hollow rib 40, which is located just outside the score lines 26a, 26b and 126a, 126b for the two tabs. The respective transverse ribs 33 and 133 end at this additional rib 40, as best seen in FIG. 8. The purpose of rib 40 is to enhance the rigidity of the can lid immediately outward from the score lines along which the tabs are torn away from the remainder of the can lid when pushed in.

I claim:

1. In a tear-open can lid having a central portion and an annular peripheral rib surrounding said central portion for sealed attachment to the top of a can body, said can lid having a pour tab embossed in said central portion and spaced inward from said peripheral rib, the improvement wherein:

said pour tab has an upwardly projecting domed segment and a substantially flat marginal lip extending laterally outward from said domed segment toward said peripheral rib at one side of the can lid, said marginal lip being substantially narrower than said domed segment radially of the can lid;

said can lid has intersecting score lines indented into one of its major faces and defining the outer edge of said marginal lip away from said domed segment;

and said can lid has a transverse rib extending across said domed segment and across said marginal lip at the ends of said score lines away from their intersection.

2. A tear-open can lid according to claim 1, wherein said score lines are indented into the top of the lid, and said transverse rib is an upwardly-projecting hollow rib.

3. A tear-open can lid according to claim 2, and having a short upwardly-projecting hollow rib extending radially inward across said marginal lip from the intersection of said score lines and terminating short of said domed segment, said short rib having a radially extending score line indented in its top face along substantially its entire extent radially of the can lid.

4. A tear-open can lid according to claim 1 and having a short hollow rib extending radially inward across said marginal lip from the intersection of said score lines, said short rib having a score line indented therein and extending radially of the can lid.

5. A tear-open can lid according to claim 4, wherein:

said intersecting score lines are indented into the top of the lid;

said transverse rib is an upwardly-projecting hollow rib;

said short rib is an upwardly-projecting hollow rib;

and said score line in said short rib is indented into its top face and extends radially inward from the intersection of said first-mentioned score lines.

6. A tear-open can lid according to claim 2, wherein said transverse rib extends across said domed segment at a location offset from the center of said domed segment toward said intersecting score lines.

7. A tear-open can lid according to claim 6, and having a short upwardly-projecting hollow rib extending radially inward across said marginal lip from the intersection of said score line.

8. A tear-open can lid according to claim 7, wherein said short rib has a score line indented into its top face and extending radially inward from the intersection of said first-mentioned score lines.

9. A tear-open can lid according to claim 8, wherein said short rib at its radially inward end terminates short of said domed segment.

* * * * *